US005175488A

United States Patent [19]

Moroney

[11] Patent Number: 5,175,488

[45] Date of Patent: Dec. 29, 1992

[54] MASTER ECL BIAS VOLTAGE REGULATOR

[75] Inventor: Andrew P. Moroney, Northboro, Mass.

[73] Assignee: Digital Equipment Corporation, Maynard, Mass.

[21] Appl. No.: 698,224

[22] Filed: May 10, 1991

[51] Int. Cl.[5] ..... G05F 3/16

[52] U.S. Cl. ..... 323/314; 323/313; 323/907

[58] Field of Search ..... 307/310, 455, 491; 323/313, 314, 907

[56] References Cited

U.S. PATENT DOCUMENTS

| | | | |
|---|---|---|---|
| 3,893,018 | 7/1975 | Marley | 323/313 |
| 4,100,477 | 7/1978 | Tam | 323/907 |
| 4,277,739 | 7/1981 | Priel | 323/314 |
| 4,553,083 | 11/1985 | Yang | 323/907 |
| 4,651,038 | 3/1987 | Cline et al. | 307/491 |
| 4,684,880 | 8/1987 | Chan | 307/455 |
| 5,025,179 | 6/1991 | Freitas | 307/491 |

*Primary Examiner*—Steven L. Stephan
*Assistant Examiner*—Jeffrey Sterrett
*Attorney, Agent, or Firm*—Ronald E. Myrick; Barry N. Young; N. Rhys Merrett

[57] ABSTRACT

A master bias voltage regulator circuit (5) has an output node for supplying a temperature compensated reference voltage (VREF1) to an input node of at least one slave ECL bias regulator circuit (4). The temperature compensated reference voltage is also compensated for a temperature-related characteristic of at least one ECL load, such as an ECL gate (2), and is also compensated for a temperature-related characteristic of the at least one slave ECL bias regulator circuit. VREF1 is sourced from an emitter of an output transistor (5Q7) and the collector of the output transistor is coupled to the emitter of a matching transistor. This technique is shown to provide improvements, relative to the prior art, in output reference voltage stability over variations in power supply voltage, temperature and process variations, while also reducing power consumption.

16 Claims, 10 Drawing Sheets

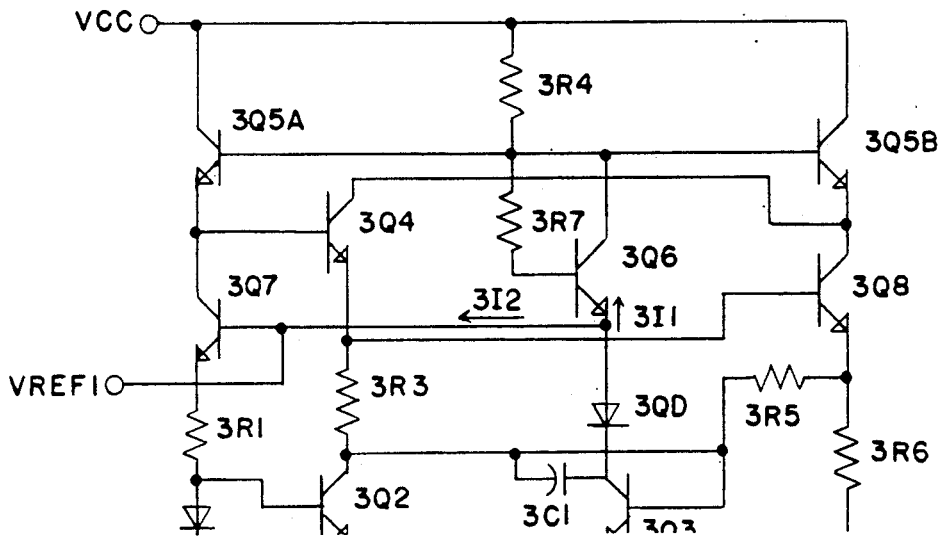
VCC
3R4
3Q5A
3Q5B
3Q4
3R7
3Q6
3Q7
3I2
3I1
3Q8
VREF1
3R3
3QD
3R5
3R1
3R6
3Q2
3C1

MASTER ECL BIAS VOLTAGE REGULATOR

FIELD OF THE INVENTION

This invention relates generally to electronic voltage regulators and, in particular, to an improved master bias voltage regulator for use with Emitter Coupled Logic (ECL) circuitry.

BACKGROUND OF THE INVENTION

Master bias regulators are employed with Very Large Scale Integration (VLSI) ECL circuitry to provide a reference voltage to slave voltage regulators. The slave voltage regulators in turn provide a reference voltage to EC logic circuits.

In order to gain an appreciation of the operation of the voltage regulator of the invention a detailed description of the prior art is presented. Specifically, there is first described a conventional bias voltage regulator (FIG. 1 and FIG. 1*a*) for ECL circuitry (FIG. 2) followed by a description of a conventional master voltage regulator (FIG. 3 and FIG. 3*a*) for use with one or more slave voltage regulators (FIG. 4).

In the Figures a numeral appearing before a device or component designator refers to the Figure number wherein the device appears. For example, transistor 1Q5A of FIG. 1 is thus distinguished from the similarly functioning transistors 3Q5A of FIG. 3 and 5Q5A of FIG. 5.

Conventional Bias Voltage Regulator (FIGS. 1 and 1*a*)

FIG. 1 and FIG. 1*a* are a schematic diagram depicting an ECL bias voltage regulator 1 of the prior art. FIG. 2 is a simplified schematic diagram of a conventional ECL gate circuit 2 that is connected during use to the regulator 1 and which obtains a reference bias voltage (VCS1) therefrom. The illustrated logic gate circuit has, by example, three logic inputs, designated A, B and C, an output designated Y, and functions as an OR gate. During use the logic gate circuit 2 is coupled between power rails VCC and VEE. VCC typically has a value of zero volts and VEE has a value within a range −4 volts DC to −7 volts DC, with −5.2 volts DC being a typical value. The value of VCSI is approximately one diode drop plus a design goal (300–600 millivolts; typical 500 mV) above VEE.

A variable supply current at a controlled temperature dependent voltage (VCS1) is sourced to the ECL logic gate 2 from output node 1A of regulator 1. VCS1 maintains a controlled voltage drop across a current source resistor RCS of the gate 2 by canceling temperature dependencies of a voltage drop across a current source transistor QCS.

The bias voltage regulator 1 maintains the VCS1 output at the desired level through the use of a Delta Voltage Base-Emitter (DVBE) generator, embodied by components 1R1, 1R2, 1R3, 1Q1, and 1Q2. The DVBE generator has a voltage output that exhibits a positive temperature coefficient characteristic.

Bias regulator 1 also includes a negative temperature coefficient current source, embodied by components 1Q8, 1R3, and 1R5. Ideally, the outputs of the DVBE generator and the negative temperature current source are related by a known function. For example, each may be designed to cancel out the temperature effect of the other.

Bias voltage regulator 1 also includes three matched transistor pairs: 1Q5A matched with 1Q7, 1Q6 matched with 1Q3, and 1Q4 that is matched, by design, to the ECL logic gate 2 current source transistor QCS.

As employed herein two transistors are considered to be matched if they are of similar construction and have, during operation, substantially equal emitter current densities which results in equal base-emitter voltage drops.

It is noted that in the Figures certain components are comprised of a plurality of parallel connected elements. For example, 1R2 is comprised of nine parallel connected resistances R2A–R21. Similarly, transistor 1Q2 is comprised of three parallel connected transistors Q2A–Q2C. The number of parallel connected components is typically a function of the magnitude of the current flow through the component. The actual number of parallel connected elements can thus be expected to vary between implementations. It is also noted that transistors having a base-collector connection, such as 1Q1 and 1QD, function as forward biased diodes and develop a diode-drop potential from collector to emitter of approximately 800 mV to 850 mV at 27° C.

The operation of the bias voltage regulator 1 is now described in the context of the following equations. The output of the bias voltage regulator 1 (VCS1) is given by:

$$VCS1 = VEE1 + Vbe(1Q3) + V(1R3) + Vbe(1Q4) + - Vbe(1Q5A) - V(1R7) - Vbe(1Q6) - Vbe(1Q7) \quad (1)$$

where Vbe represents the base to emitter voltage drop of the indicated transistor.

In that 1Q3 and 1Q6 are matched pairs, as are 1Q5A and 1Q7, Equation (1) may also be expressed as:

$$VCS1 = VEE1 + V(1R3) + Vbe(1Q4) - V(1R7). \quad (2)$$

The component values of the DVBE generator (devices 1R1, 1R2, 1R3, 1Q1, and 1Q2) and the negative temperature coefficient current source (devices 1Q8, 1R3, and 1R5) are adjusted during design such that the voltage (V(1R3)) appearing across 1R3 is equal to a desired voltage {V(TARGET)} across the ECL gate 2 current source resistor RCS, plus a parasitic term due to the base current (IB) of 1Q3. A design-determined temperature dependency of the magnitude of V(1R3) is a result of the base current parasitic of 1Q3 and a term dV(TARGET)/dT.

Thus, the following relationships exist:

$$V(1R3) = V(\text{TARGET}) + \{1R3 * 1R5/[1R3 + 1R5]\} * IB(1Q3); \text{ and} \quad (3)$$

$$dV(1R3)/dT = \{1R3 * 1R5/[1R3 + 1R5]\} * dIb(1Q3)/dT + dV(\text{TARGET})/dT \quad (4)$$

where the symbol (*) denotes multiplication.

If the resistance of 1R7 is set equal to the term {1R3 * 1R5/[1R3+1R5]}, and in that 1Q3 is matched to 1Q6 and Ib(1Q3) therefore equals Ib(1Q6), Equation (2) may be expressed as:

$$VSC1 = VEE1 + V(\text{TARGET}) + Vbe(1Q4), \text{ and} \quad (5)$$

$$dVCS1dt = dVEE1/dT + dVbe(1Q4)/dT, \text{ or}$$

$$dVCS1/dT = dV(\text{TARGET})/dT + dVbe(1Q4)/dT$$

since $$dVEE1/dT = 0\ mV/c.$$

As viewed by the ECL logic gate 2:

$$VSC1 = VEE1 + V(RCS) + Vbe(QCS1), \text{ or}$$

$$V(RCS) = VCS1 - VEE1 - Vbe(QCS1).$$

By combining equations (8) and (5), and in that 1Q4 and the logic gate 2 transistor QCS are matched, it can be shown that:

$$V(RCS) = V(TARGET), \text{ and} \quad (9)$$

$$dV(RCS)/dT = dV(TARGET)/dT, \quad (10)$$

as is desired

In that both V(TARGET) and dV(TARGET)/dT are set by the operation of the DVBE generator (devices 1R1, 1R2, 1R3, 1Q1, and 1Q2) and by the negative temperature coefficient current source (devices 1Q8, 1R3 and 1R5), conventional practice adjusts these two circuit blocks until the desired dV(TARGET)/dT and V(TARGET) are achieved. Such modifications normally entail adjusting the values of 1R2, 1R3, and 1R5. It is generally desirable that the magnitude of V(RCS) be stable with respect to temperature, or dV(TARGET)/dT typically equals 0 mV/C. For ECL circuitry, values for V(TARGET) range from 400 mV to 600 mV.

As is evident from Equation (9), the only dependencies of V(RCS) relate to V(TARGET), or the operation of the DVBE generator and the negative temperature coefficient current source circuit blocks. The operation of these circuit blocks is independent of first order effects from the voltage supply, is normally adjusted to be independent of temperature, and typically is affected only slightly by fabrication process induced effects.

However, as the level of ECL circuit integration is increased the output current from the bias regulator 1 must also be increased to accommodate the increased ECL circuit power requirement. One technique to increase the current capacity of the bias regulator 1 is to enlarge the transistors. However, the voltage at the ECL logic gate 2 has been found to fluctuate due to increased 1R losses within the interconnecting metal between the bias voltage regulator 1 and the logic gate 2. These fluctuations result in a degradation in the performance of the gate 2 output voltage stability, further resulting in increased gate failure due to a reduction in immunity to noise.

Conventional Master Bias Voltage Regulator (FIGS. 3 and 3*a*)

To overcome this problem related to increased 1R losses at higher ECL integration levels the prior art adds a second tier of bias voltage regulators. The conventional bias regulator 1 is modified as indicated in FIG. 3, FIG. 3*a* and FIG. 3*b* and is employed as a "master" bias voltage regulator 3 to supply a reference bias voltage (VREFl) to a plurality of "slave" bias regulators 4 of a type depicted in FIG. 4. The slave bias regulators 4 each provide the bias voltage VCS1 to their associated ECL circuitry. The slave bias regulators 4 are placed in close proximity to the ECL circuitry to reduce 1R losses in the interconnecting metal. By example, one of the master bias voltage regulators may supply up to 90 slave regulators and each slave up to 20 gates.

Modifications that are required to be made to the conventional bias regulator 1 include raising the output voltage (VREFl) by one diode drop (approximately 800 mV to 850 mV at room temperature), to accommodate the slave bias regulator 4 circuitry, and adjusting transistor sizes to accommodate the increase in required current. As can be seen in FIG. 3 and 3*a*, the increased diode drop is achieved by sourcing current from the emitter of 3Q6 (node 3A) rather than from the emitter of 3Q7.

However, sourcing current from the emitter of 3Q6 results in a requirement that 3Q5A match the slave transistor 4QOF4 and, therefore, also results in the 3Q6/3Q3 transistor pair not being matched, as was the case for the bias voltage regulator 1. As a result:

$$VREF1 = VEE1 + Vbe(3Q3) + V(3R3) + Vbe(3Q4)30\ Vbe(3Q5A) - V(3R7) - Vbe(3Q6). \quad (11)$$

In this regard, reference is made to FIG. 1*a* and FIG. 3*a*. In FIG. 1*a* the current density through the emitters of matched transistors 1Q6 and 1Q3 is substantially identical in that a relatively small amount of current is diverted through the base-collector jumper across 1QD to the base of 1Q7. Thus, III is substantially equal to II2. In contradistinction, in FIG. 3*a* a magnitude of a current 3II through the emitter of 3Q6 is significantly larger than the magnitude of the current 3I3 through the emitter of 3Q3. This is due to the diversion of a significant amount of current (3I2) to the slave regulators 4. This current imbalance results in 3Q6 not being matched to 3Q3, even though they are of similar construction, and creates a variable condition, not found in the regulator 1, that is a function of voltage, loading, and temperature.

The slave bias regulator 4 exhibits the following characteristic:

$$VCS1 = VREF1 - Vbe(4QOF4), \text{ or} \quad (12)$$

$$VCS1 = VEE1 + Vbe(3Q3) + V(3R3) + Vbe(3Q4) - V(3R7) - Vbe(3Q6). \quad (13)$$

By substituting the well-known transistor equation approximation ($Vbe = kT/e * \ln[Ic/Is] + Re * I_e$), and also Equation (3), which remains valid for the DVBE generator of the master bias voltage regulator 3, the following relationships can be shown to exist for the slave bias regulator 4:

$$VSC1 = VEE1 + V(\text{TARGET}) + Vbe(3Q4) + \{[3R3 * 3R5]/[3R5 + 3R3]\} * Ib(3Q3) - 3R7 * Ib(3Q6) + kT/e * \ln[Ic(3Q3)/Ic(3Q6)] + Re(3Q3) * [Ie(3Q3) - Ie(3Q6)]. \quad 14)$$

or $$VCS1 = VEE1 + V(\text{TARGET}) + Vbe(3Q4) + \{\{\{[3R3*3R5]/[3R5 + 3R3]\} * Ic(3Q3) - 3R7 * Ic(3Q6)\}/B(3Q3)\} + [kT/e] * \ln[Ic(3Q3/Ic(3Q6)] + \{Re(3Q3) * [Ie(3Q3) - Ie(3Q6)]\}. \quad 15)$$

where (B) is the transistor beta value and (Re) is the transistor emitter resistance Since, $$Ic(3Q3) = Ic(3Q6) - IVREF1 \text{ (approximately).} \quad 16)$$

then $$VCS1 - VEE1 = V(\text{TARGET}) + Vbe(3Q4) + \{\{\{3R3*3R5]/[3R3 + 3R5] - 3R7\} * Ic(3Q6) - \{[3R3 * 3R5]/[3R3 + 3R5]\} * IVREF\} * 1/B(3Q3)\} + [kT/e] * \ln\{(Ic(3Q6) - IVREF]/Ic(3Q6\} - \{Re(3Q3) * IVREF\}. \quad 17)$$

Using Equation (8):

$$V(RCS) = V(\text{TARGET}) + \{\{\{[3R3 * 3R5]/[3R3 + 3R5] - 3R7\} * Ic(3Q6) - \{[3R3 * 3R5]/ [3R3 + 3R5]\} * IVREF\} * 1/B(3Q3)\} + [kT/e] * \ln\{[Ic(3Q6) - IVREF]/Ic(3Q6)\} - \{Re(3Q3) * IVREF\}. \quad 18)$$

As is apparent from Equation (18), during the design of the conventional master bias voltage regulator 3 it is required to set both V(TARGET) and dV(TARGET)/dT, and to also estimate the effects of several environmental variables. However, these environmental variables are not subject to precise control. By example, the variables listed below all have a direct or an indirect relationship to temperature, voltage, or process effects, as shown in equation (18).

One variable relates to a relationship between temperature and output voltage. An effect of this variable upon the operation of regulator 3 is increased as IVREF approaches Ic(3Q6).

Another variable is related to Ic(306) in that the current flow through the 3Q6 emitter is both voltage and temperature dependent, since:

$$Ic(3Q6) = \{VCC - VEE1 + Vbe(3Q3) + V(3R3) + Vbe(3Q4) + Vbe(3Q5A)\}/3R4. \quad (19)$$

where (VCC−VEE1) represents the voltage across the regulator 3. All transistor Vbe terms in equation (19) vary as a function of temperature.

Another variable is related to IVREF and causes the regulator 3 output current to directly influence the output voltage (VREFl) and to vary with changing loads or process-related variations.

Finally, variables related to B(3Q3) and Re(3Q3) indicate that the Beta and emitter resistance values of 3Q6 and 3Q3 (devices of similar construction) are subject to process variations and influence the output voltage (VREFl) stability.

The extent of any of the output variations caused by these variables may be reduced by increasing Ic(3Q6) such that:

$$Ic(3Q6) >> IVREF. \quad (20)$$

Equation (18) may therefore be simplified to:

$$V(RCS) \sim = V(\text{TARGET}). \quad (20)$$

provided that 3R7 [3R3 * 3R5]/[3R3+3R5]. It therefore follows that:

$$dV(RCS)dT \sim = dV(\text{TARGET})/dT. \quad (22)$$

Thus, in order to maintain an acceptable degree of independence from environmental variables with the conventional bias voltage regulator 3 it is necessary to maintain a collector current through 3Q6 that is significantly greater than the output current from node 3A. As a result, the conventional master bias regulator 3 is required to consume more power than the bias regulator 1 in order to provide acceptable performance. This conventional design therefore also requires a significantly larger circuit layout area.

It should be noted that variations may also be reduced by decreasing the resistance values of 3R1, 3R2, 3R3, 3R5, 3R6, and 3R7. However, this technique also increases the regulator 3 power consumption.

It is thus one object of the invention to provide a master voltage regulator that exhibits an improved voltage stability over variations in power supply voltage, temperature, and process-related effects while also beneficially reducing power consumption relative to th conventional master bias voltage regulator.

It is another object of the invention to provide a master voltage regulator that exhibits an improved voltage stability to achieve an improved ECL logic gate immunity to noise and a corresponding increase in ECL gate stability and reliability.

SUMMARY OF THE INVENTION

The foregoing and other problems are overcome and the objects of the invention are realized by an improved master bias voltage regulator circuit, and to a method of operating same, that has an output node for supplying a temperature compensated reference voltage to an input node of at least one slave ECL bias regulator circuit. In accordance with the invention the temperature compensated reference voltage is also compensated for a temperature-related characteristic of at least one ECL load, such as an ECL gate, and is also compensated for a temperature-related characteristic of the at least one slave ECL bias regulator circuit.

Further in accordance with the invention the output node of the improved master bias voltage regulator is sourced from an emitter of an output transistor and the collector of the output transistor is coupled to the emitter of a matching transistor. This technique is shown to provide improvements, relative to the master bias voltage regulator of the prior art, in output reference voltage stability over variations in power supply voltage, temperature and process variations, while also beneficially reducing power consumption. The improvement in output reference voltage stability furthermore results in an improvement, relative to the prior art, in immunity to noise, with a corresponding increase in stability and reliability of ECL logic circuits that are coupled to the slave bias voltage regulators. The teaching of the invention is applicable to all ECL technologies that operate with a master/slave bias regulator configuration.

BRIEF DESCRIPTION OF THE DRAWING

The above set forth and other features of the invention are made more apparent in the ensuing Detailed Description of the Invention when read in conjunction with the attached Drawings, wherein:

FIG. 3*b* is a simplified schematic diagram of the ECL master bias voltage regulator depicted in FIGS. 3 and 3*a;*

DETAILED DESCR1PTION OF THE INVENTION

Figure 5:
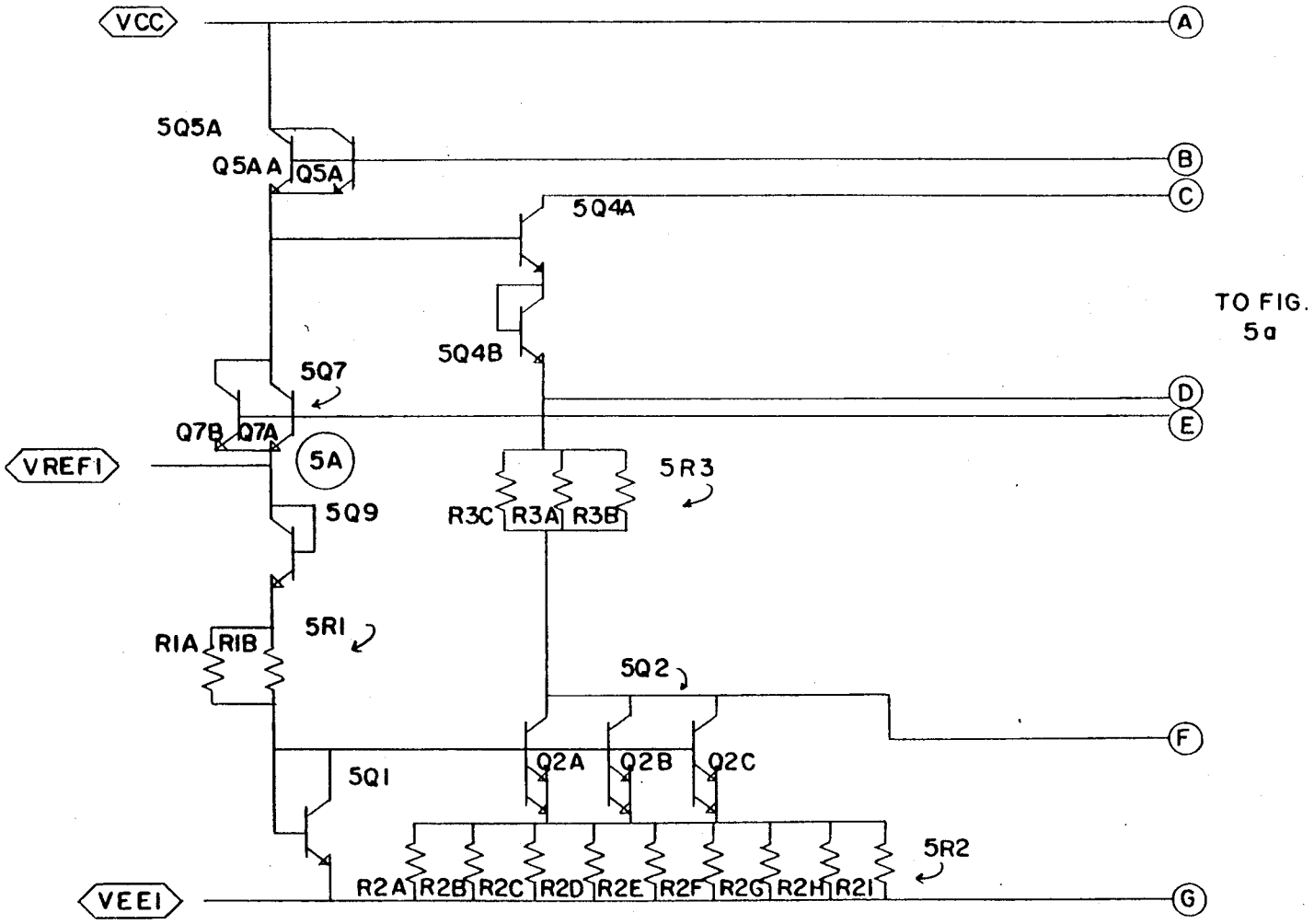
FIG. 5 and FIG. 5*a* are a schematic diagram depicting an ECL master bias voltage regulator constructed-/in accordance with the invention.
Figure 5A:
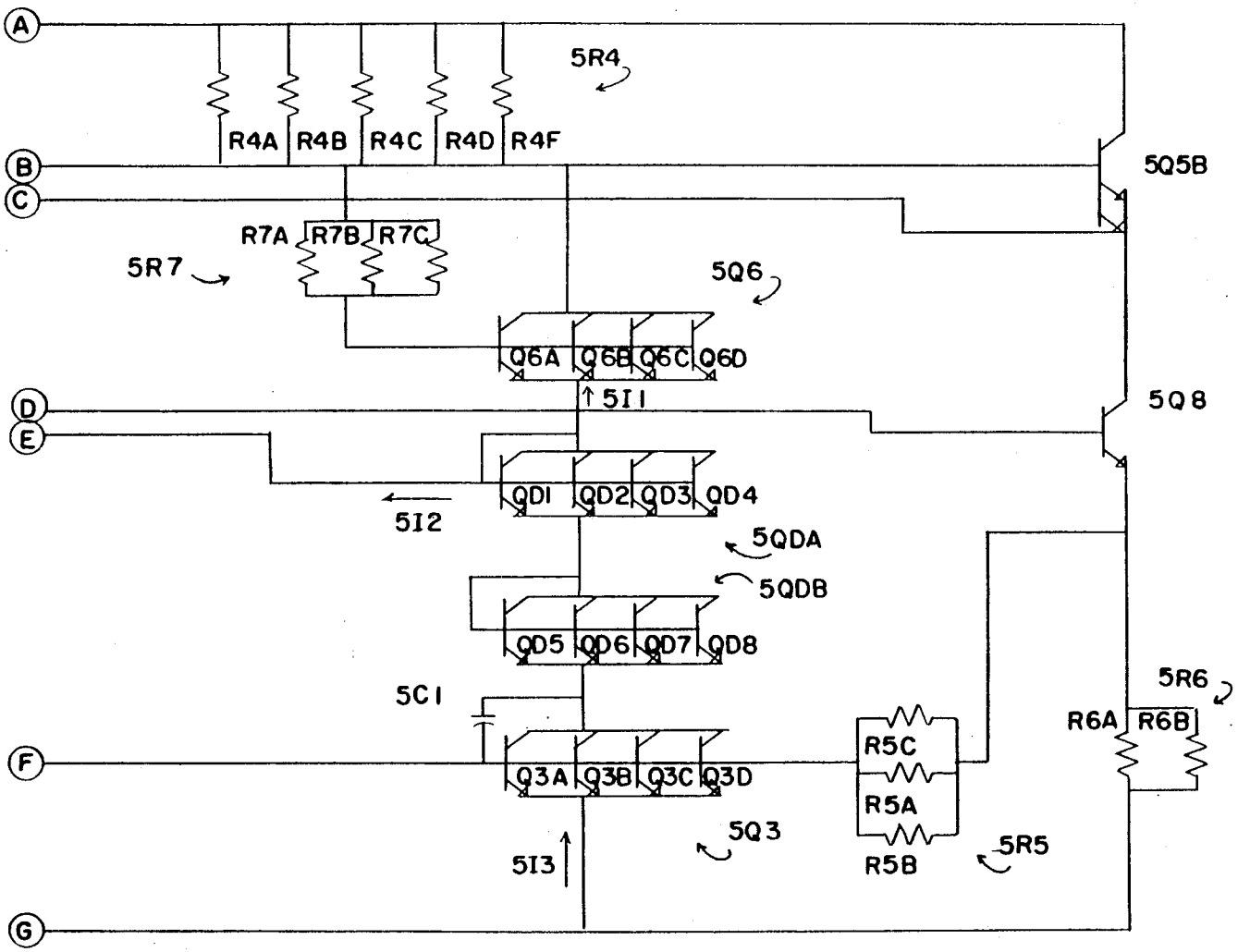
Figure 5B:
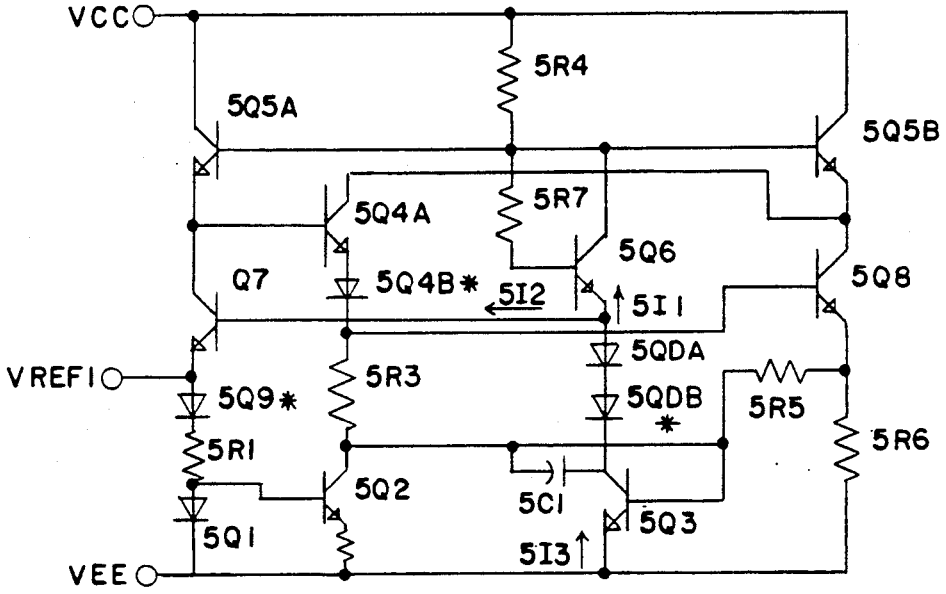
FIG. 5*b* is a simplified schematic diagram of the ECL master bias voltage regulator depicted in FIGS. 5 and 5*a*.

Referring now to FIG. 5, FIG. 5*a* and 5*b* there is depicted an ECL master bias voltage regulator 5 constructed in accordance with the invention. The master bias voltage regulator 5 is also referred to a Modified Matched-Paired Cancellation Master Regulator for the reasons that are made apparent below. In FIG. 5*b* the component designators followed by an asterisk (*), specifically 5Q9, 5Q4B, and 5QDB, are components not found in the bias voltage regulator 1. Otherwise, the circuitry depicted in schematic FIG. 5*b* is substantially identical to that of the bias voltage regulator 1. The operation of these additional components is described in detail below.

The master bias voltage regulator 5 includes a DVBE generator, embodied by components 5R1, 5R2, 5R3, 5Q1, and 5Q2, where 5Rl and 5Q1 form a current source necessary for the operation of the DVBE generator. Regulator 5 also includes a negative temperature coefficient current source, embodied by components 5Q8, 5R3, and 5R5. Other similarly labeled components function in a manner as previously described, with any exceptions being described in detail below.

Figure 1:
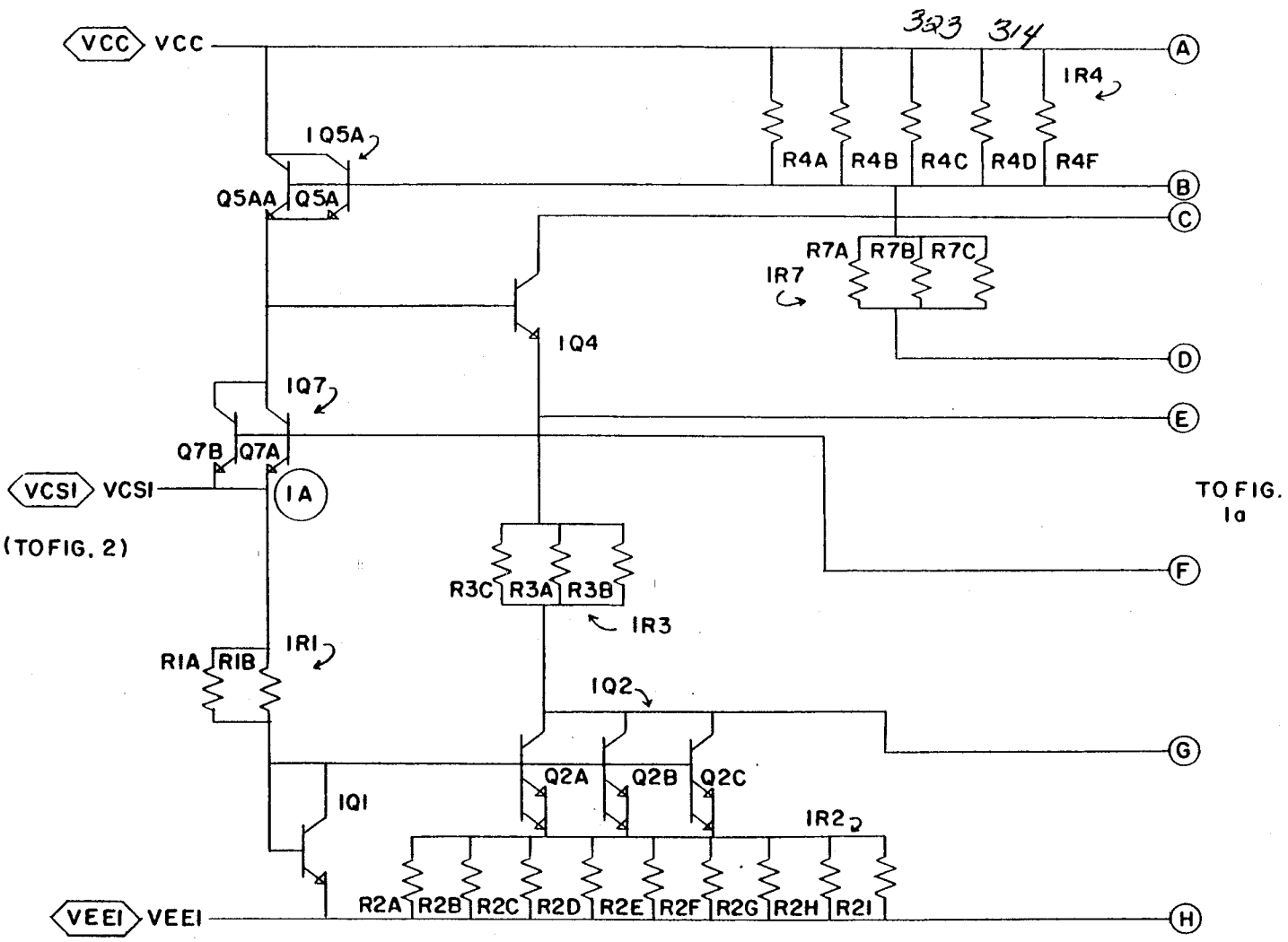
FIG. 1 (PRIOR ART)
FIG. 1 and FIG. 1*a* are a schematic diagram depicting an ECL bias voltage regulator of the prior art.
Figure 1A:
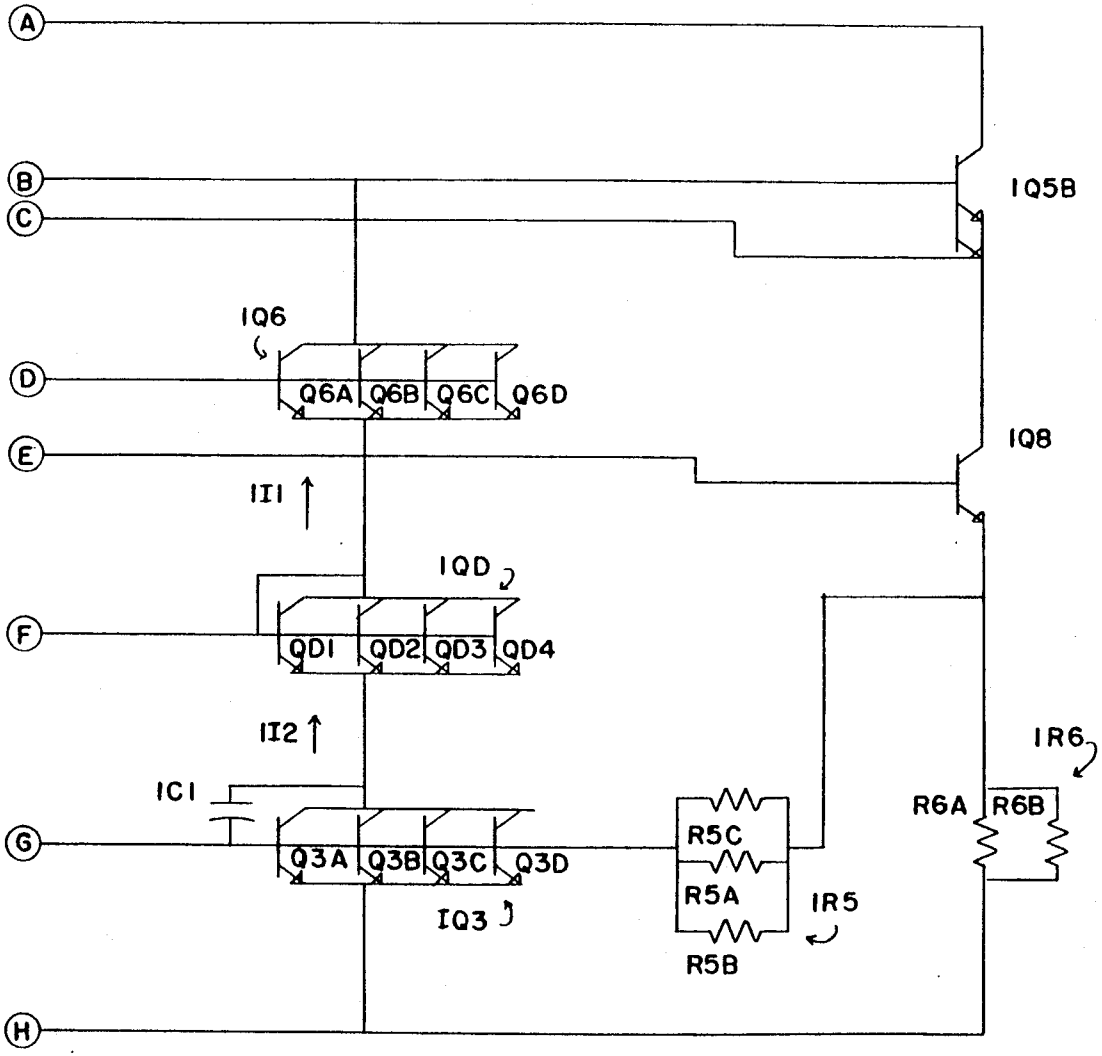
FIG. 1a (PRIOR ART)

The output bias voltage (VREF1) is sourced from the emitter of 5Q7, as in the bias voltage regulator 1 of FIG. 1, instead of from the emitter of 3Q6, as in the prior art master bias voltage regulator 3. As a result, a significant amount of current is not diverted away from 5Q3 and the transistor pair 5Q6/5Q3 is matched, resulting in improved output voltag stability. The magnitude of VREF1 is increased by one diode drop, relative to the regulator 1, in order to be compatible with the slave bias regulator 4. The increased diode drop potential of VREFI is achieved by the addition of transistor 5Q4B in series with 5Q4A. Transistor 5Q4B is matched to the slave transistor 4QOF4 as indicated by:

$$VREF1 = VEE1 + Vbe(5Q3) + V(5R3) + Vbe(5Q4B) + Vbe(5Q4A) + Vbe(5Q5A) - V(5R7) - Vbe(5Q6) - Vbe(5Q7). \quad (23)$$

In that $$V(5R3)=V(TARGET)+\{[5R3 * 5R5]/[5R3+5R5]* Ib(5Q3)\}, \quad (24)$$

by applying Equation (3), and by setting $$5R7=[5R3 * 5R5]/5R3+5R5].$$

then $$VREF1=VEE1+V(TARGET)+Vbe(5Q4A)+-Vbe(5Q4B). \quad (25)$$

Or, using Equation (12):

$$VCS1=VEE1+V(TARGET)+Vbe(5Q4A). \quad (26)$$

In that 5Q4A is matched to QCS, by using Equation (8) for the logic gate 1 it can be seen that:

$$V(RCS)=V(TARGET). \quad (27)$$

Correspondingly, it is seen that:

$$dV(RCS)/dT=dV(TARGET)/dT. \quad (28)$$

As a result of the addition of transistor 5Q4B two additional adjustments are made to the Modified Matched Pair Cancellation Master Bias Regulator 5. The first adjustment is an addition of transistor 5QDB in series with with 5QDA. Transistor 5QDB is connected to operate as a diode and operates to reduce the base-collector voltage of 5Q3.

In this regard it is noted that in the three regulators 1, 3 and 5 frequency stability is enhanced through the addition of a bipolar junction capacitor (Cl) across the base-collector junction of Q3; that is, across 1Q3, 3Q3 or 5Q3. However, since some bipolar junction capacitors possess a low breakdown voltage, it is desirable for the base-collector voltage of Q3 to be less than one volt. For the regulator of FIG. 5, and without QDB, the addition of 5Q4B would increase the base-collector voltage of 5Q3 from approximately 550 mV to over 1400 mV. Thus, the addition of transistor 5QDB beneficially reduces the base-collector voltage of 5Q3, enabling the bipolar junction capacitor 5C1 to be employed to improve the frequency stability of the regulator 5.

Figure 2:
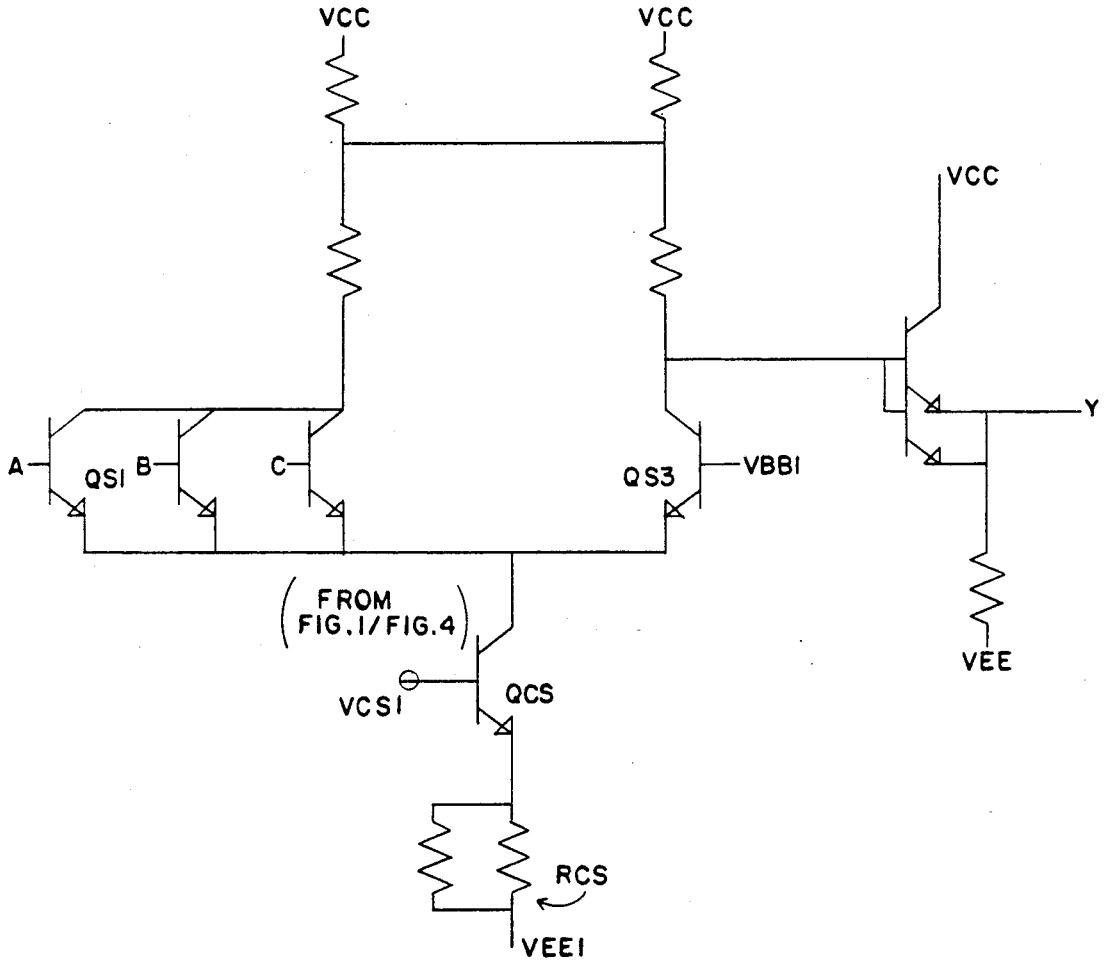
FIG. 2 (PRIOR ART)
FIG. 2 is a schematic diagram illustrating an ECL gate circuit.

The second adjustment is the addition of transistor 5Q9 connected in series with the DVBE generator current source 5R1 and 5Q1. The DVBE generator presented in FIG. 5, and also in FIGS. 1 and 3, requires that a constant voltage with known temperature dependency exist across 5R1, similar to the requirement across RCS of the ECL logic gate 1. In the conventional regulators previously discussed Q1 is matched to Q4 and Q7 is matched to Q5. Therefore:

$$V(R1)=V[TARGET] \quad (29)$$

and $$dV(R1)/dT\ C(design) \quad (30)$$

where C(design) is typically made equal, by design, to 0 mV/C for the gate of FIG. 2.

However, in the embodiment of FIG. 5 the emitter potential of 5Q7 is made one diode drop higher by the addition of 5Q4B. In order to maintain the condition expressed in Equation (25), 5Q9 is added and is matched to 5Q4B. Therefore:

$$VREF1=VEE1+Vbe(5Q1)+V(5R1)+Vbe(5Q9), \quad (31)$$

ps $$Vbe(5Q4A)+V[TARGET]+Vbe(5Q4B)=-Vbe(5Q1)+V(5R1)+Vbe(5Q9), \text{ and} \quad (32)$$

$$V(5R1)\ V[TARGET], \quad (33)$$

whioh oan be seen to oorrespond to Equation (29).

Figure 3:
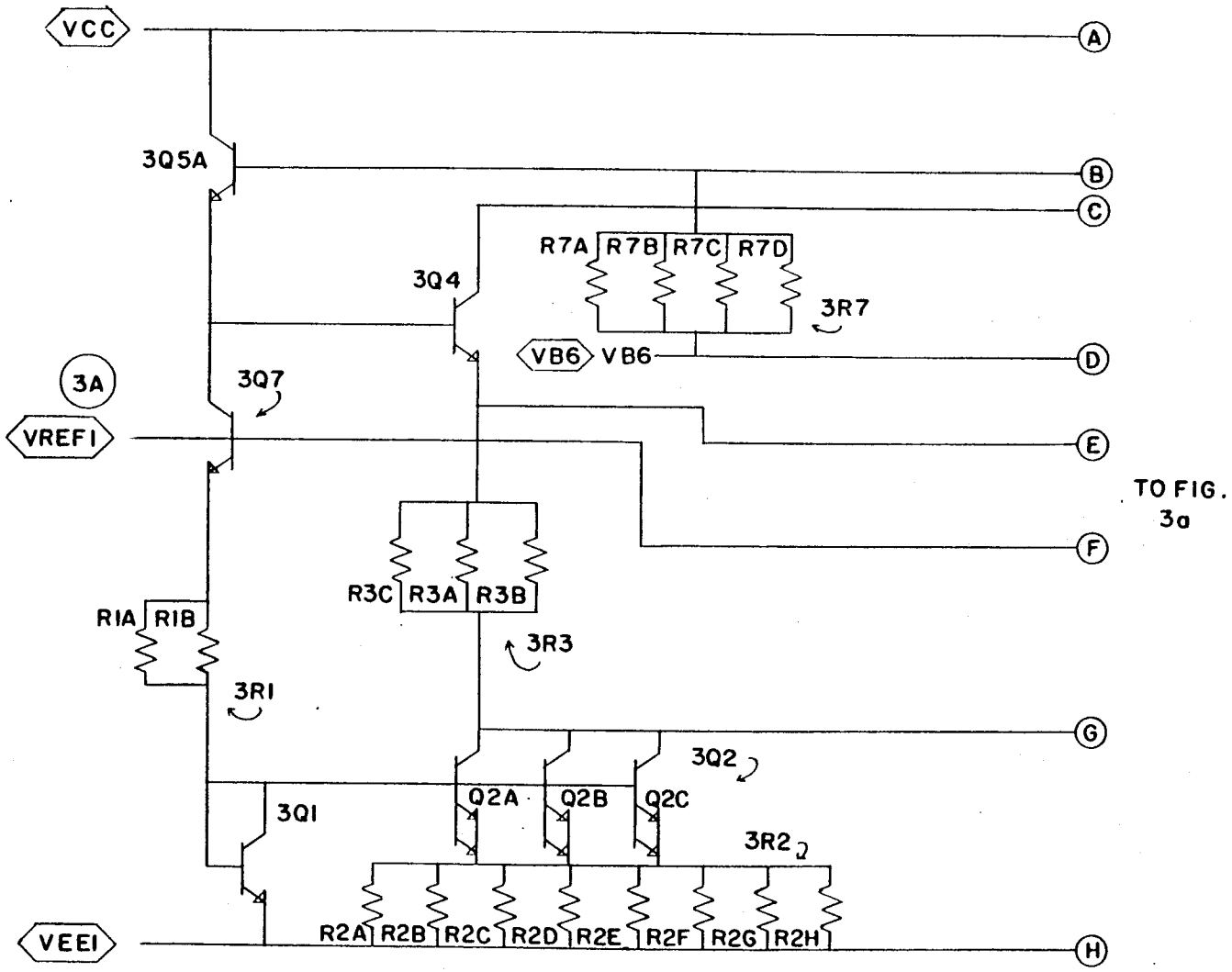
FIG. 3 (PRIOR ART)
FIG. 3 and FIG. 3*a* are a schematic diagram depicting an ECL master bias voltage regulator of the prior art.
Figure 3A:
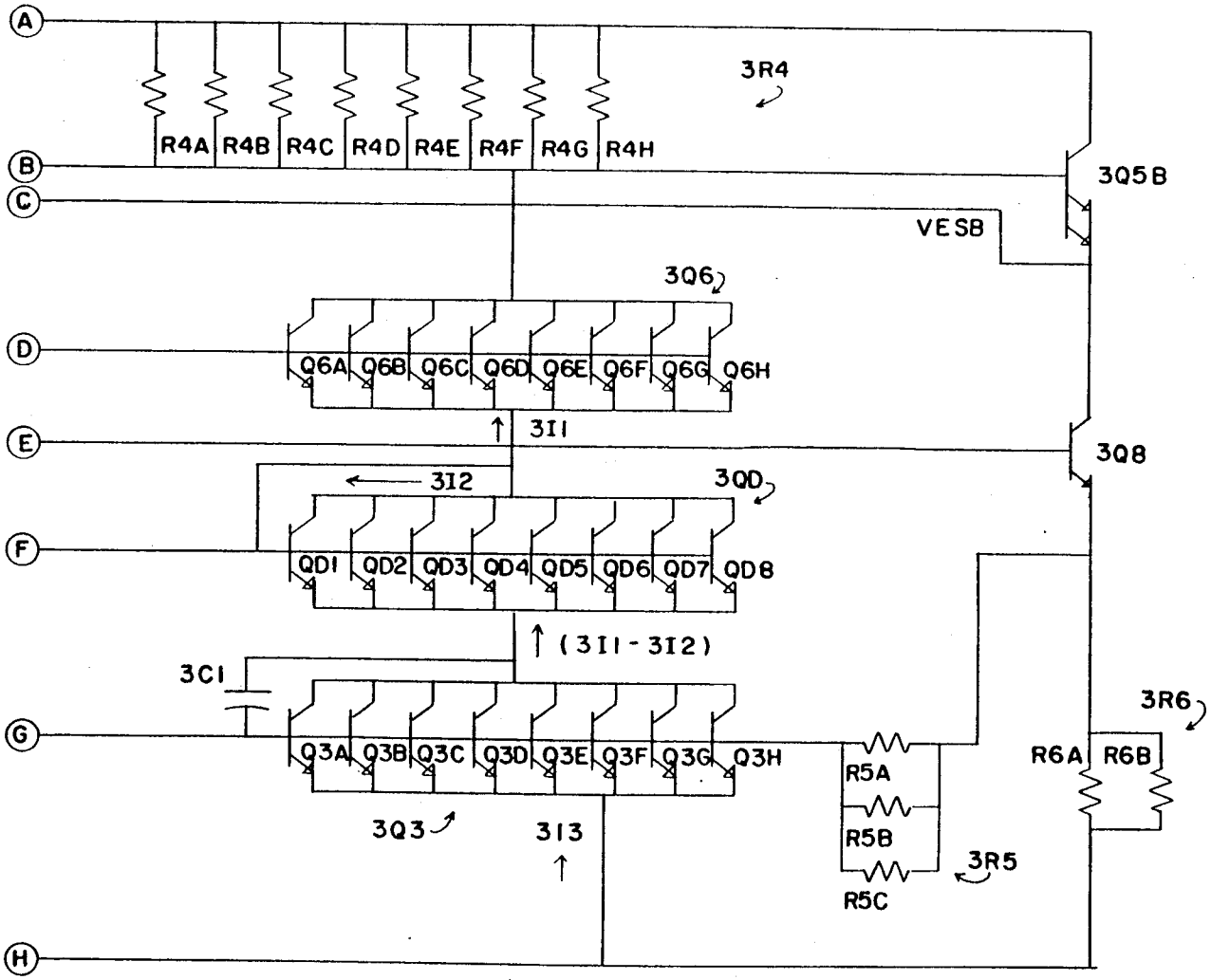
FIG. 3a (PRIOR ART)
Figure 4:
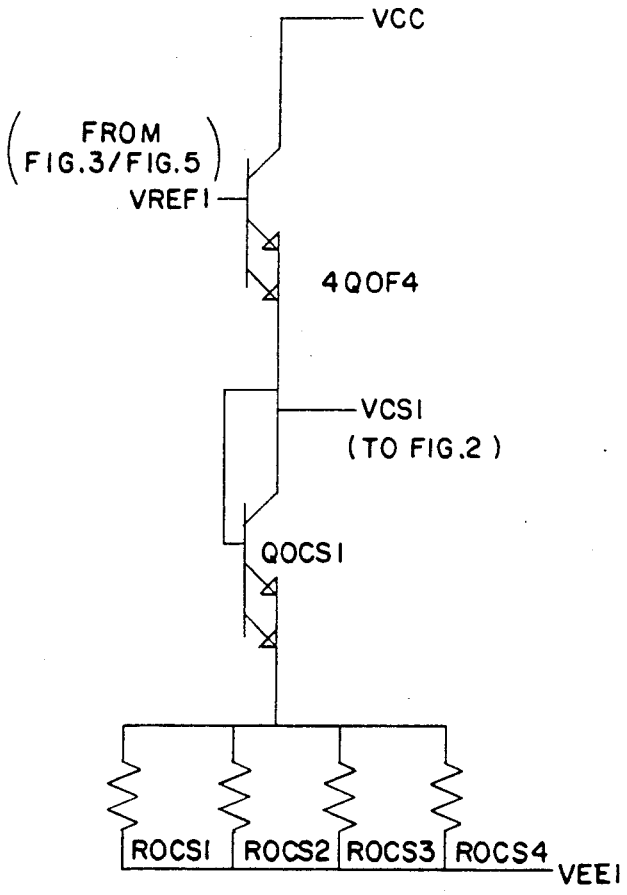
FIG. 4 (PRIOR ART)
FIG. 4 is a schematic diagram illustrating a slave bias voltage regulator used with the master voltage regulator of FIGS. 3 and 3*a* and 3*b;*

It is noted that due to the presence of 5Q4B the potential at the base of 5Q5 is one additional diode drop closer to the VCC rail than is the base of 3Q5A in FIG. 3. As a result, the voltage drop across 5R4 is also reduced and is less than that across 3R4 in the prior art regulator 3.

In that:

$$V(5R4)=VCC-(VEEl+Vbe(5Q3)+V(5R3)+-Vbe(5Q4B)+Vbe(5Q4A)+Vbe(50Q5A), \quad (34)$$

as the magnitude of VCC−VEE1 decreases, so also does the voltage V(5R4). If V(5R4) approaches zero, then Ic(5Q6) will also approach zero since:

$$Ic(5Q6)=V(5R4)/5R4. \quad (35)$$

If Ic(5Q6) approaches zero the regulator 5 will fail to operate.

The prior art regulators 1 and 3 are capable of operating at a VCC/VEE1 differential of 3 volts. However, the additional diode drop imposed by 5Q4B requires a voltage differential of at least 3.8 volts for proper operation. This wider VCC/VEE1 differential is not of concern, however, in that a majority of conventional ECL logic operates at a VCC/VEE voltage differential of 4.0 volt or more.

In summary, the ECL bias voltage regulator 1 was found to be unsatisfactory because it lacked the ability to provide the higher voltage differential (from VEEl), and the additional temperature compensation, required by the slave bias voltage regulator 4. The conventional master bias voltage regulator 3 provided the extra voltage and temperature compensation by matching device 3Q5A with the slave regulator,s 4QOF4 (the use of 4QF4 imposing the requirement for additional voltage and temperature compensation). Unfortunately, this was achieved by sacrificing the matched output transistors (1Q7 and 1Q5A) and by upsetting an internal voltage/temperature/process compensation between devices 3Q6 and 3Q3; it being remembered that 3Q3 functions as a part of the DVBE generator and that 3Q6, the compensating device for 3Q3, was also required to function as the output transistor.

The requirement for the stabilizing capacitor is dependent upon the bipolar technology used. That is, not all technologies require the use of the capacitor. Also, some technologies may produce bipolar capacitors that have lower leakage currents and that withstand higher voltages. In either of these cases, it may be possible to eliminate 5QDB altogether, provided that the resultant increase in base-collector voltage does not cause a mismatch between 5Q3 and 5Q6.

The input to the slave bias voltage regulator 4, that is VREF1, differs by two diode drops from the VEE1 power rail, and from the TARGET voltage which occurs across RCS (FIG. 2).

The output of the slave bias voltage regulator 4, that is VCS1, differs by one diode drop from the VEE1 power rail, and from the TARGET voltage. VCS1 is the input to the ECL gate current source and is one diode drop less than VREF1.

The output of the master bias voltage regulator 5 is provided by the matched transistor pair 5Q7 and 5Q5A. The regulator 5 is designed such that the effect of the output current upon 5Q5A cancels out those upon 5Q7. This approach was employed by the ECL bias voltage regulator 1 of FIG. 1, but was not employed for the conventional master bias voltage regulator 3 of FIG. 3.

The use of the invention provides the additional voltage and temperature compensation required by The master bias voltage regulator 5 improves upon this prior art by providing devices 5Q4B, 5Q9, and QDB.

In accordance with the invention, device 5Q4B is provided to produce the temperature compensation required to cancel out the temperature effects of the slave bias voltage regulator 4 and to provide the additional voltage required by the slave regulator 4.

Device 5Q9 is provided to compensate for the presence of 5Q4B. That is, the addition of 5Q4B introduces a temperature dependency to the positive temperature coefficient generator current source (5R1 and 5Q1) and this temperature dependency is nulled by 5Q9.

Device 5QDB is provided to permit the use of the stabilizing capacitor 5Cl across the base-collector (B-C) junction of 5Q3. In the prior art, the voltage across this B-C junction is approximately 500 mV. However, the addition of 5Q4B increases this B-C voltage to approximately 1300 mV. For some bipolar technologies, the bipolar capacitor tends to have a high leakage current at voltages greater than one volt. The addition of 5QDB beneficially reduces the B-C junction potential to approximately 500 mV. In addition, by maintaining the Vbe of 5Q3 at a lower level, transistor matching is better maintained between devices 5Q3 and 5Q6. the slave bias voltage regulator 4 in a manner that does not compromise the matched output transistor pair 5Q5A and 5Q7. 5Q6 is not required to function as an output device, it is employed to balance out 5Q3.

The voltage V(TARGET) may vary from approximately 400 mV to approximately 600 mV. For the ECL logic gate shown in FIG. 2, it is typically desired to have V(TARGET) indepdnent of temperature. However, it should be noted that there are other types of logic gates which require V(TARGET) to have a predetermined temperature dependency. This predetermined temperature dependency is provided by adjusting the positive and negative temperature coefficient blocks present in all three regulator designs. Thus, it should also be noted that dV(TARGET)/dT is not required to equal 0 mV/C for the modified master bias voltage regulator 5 to function.

The following is a summary of the funtionality of the various devices shown in the Figures.

Devices with functions specific to the prior art regulator of FIG. 1 include the following.

| Device | Function: |
|---|---|
| 1Q7 | Output Transistor. This device provides VCS1 to the ECL gate 2 by sourcing current from the emitter of 1Q7. |
| 1Q5A | Output Transistor's Match. This device cancels out the voltage drop across 1Q7's base-emitter and also cancels out any teperature/loading variation effects induced by 1Q7. Output current also flows through this device. |
| 1Q6 | Gain Stage Transistor's Match. This device cancels out the voltage drop across 1Q3's base-emitter and also cancels out any temperature/loading variation effects induced by 1Q3. The base current of this device is utilized by R7 to cancel the base current effects of Q3. |
| 1Q4 | Gate Transistor's Match. This device produces the voltage with appropriate temperature coefficients required by the ECL gate 2 current |

-continued

| Device | Function: |
|---|---|
| | transistor, QCS. |

Devices with functions specific to the prior art regulator of FIG. 3 include the following.

| Device | Function: |
|---|---|
| 3Q5A | Slave Transistor's Match. This device produces the extra voltage potential with appropriate temperature coefficients required by the slave bias voltage regulator 4. This device is matched to 4QOF4 in the slave regulator 4. |
| 3Q4 | Gate Transistor's match. This device produces the voltage potential with appropriate temperature coefficients required by the ECL gate 2 current transistor, QCS. |
| 3Q6 | Output Transistor. This device sources current to the slave regulators. The output current is diverted from the regulator's feedback path. This device must also attempt to cancel out the base-emitter voltage of 3Q3. However, since the output current may vary, device matching is not always optimum and, as a result, voltage, temperature, loading, and manufacturing process variations are introduced. |
| 3Q7 | DVBE Current Source Compensation Transistor. This device cancels, or matches, the effects of 3Q5A within the regulator and allows the current source associated with the DVBE generator to perform without extra uncontrolled temperature coefficients. |

Devices with functions specific to the embodiment of the invention depicted in FIG. 5 include the following.

| Device | Function |
|---|---|
| 5Q4A | Gate Transistor's Match. This device produces a voltage potential with appropriate temperature coefficients as required by the ECL gate 2 current transistor, QCS. |
| 5Q4B | Slave Transistor's Match. This device produces an additional voltage potential with appropriate temperature coefficients required by the slave bias voltage regulator 4 and is matched to 4QOF4. |
| 5Q7 | Output Transistor. This device provides VREF1 to the slave voltage regulator(s) by sourcing current from its emitter. |
| 5Q5A | Output Transistor's Match. This cancels out the voltage drop across 5Q7's base-emitter and also cancels out any temperature/loading variation effects induced by 5Q7. Output current also flows through this device. |
| 5Q6 | Gain Stage Transistor's Match. This device cancels out the voltage drop across 5Q3's base-emitter and also cancels out any temperature/loading variation effects induced by 5Q3. Base current of this device is |

-continued

| Device | Function |
|---|---|
| | utilized by 5R7 to cancel the base current effects of 5Q3. |
| 5Q9 | DVBE Current Source Compensation Transistor. This device cancels the effects of 5Q4B within the regulator 5 and enables the current source associated with the DVBE generator to perform without additional uncontrolled temperature coefficients. |
| 5QDB | Step Down Transistor (III). This device reduces an additional base-collector voltage of device 5Q3 induced by the presence of 5Q4B and insures that 5Q3 better matches 5Q6 and that the bipolar capacitor 5C1, if used, will experience a relatively low junction voltage. |

Devices with functions common to FIGS. 1, 3 and 5 include the following.

| Device | Function: |
|---|---|
| 1Q1, 3Q1, 5Q1 | Current Source Transistor for the DVBE generator. This device has the same properties (VBE and temperature coefficient) as the device Q4 (or Q4A in FIG. 5). |
| 1Q2, 3Q2, 5Q2 | Delta transistor of the DVBE generator. This device is set with the combination of R2 and Q1 so that Q2's base-emitter voltage is less than Q1's base-emitter voltage. |
| 1R1, 3R1, 5R1 | Current Source Resistor for the DVBE generator. This resistor has properties similar to R3 (but not exact due to parasitic elements produced by the base current of device Q3). The potential V(TARGET) occurs across R1 if Q1 is properly adjusted. |
| 1R2, 3R2, 5R2 | Delta Resistor of the DVBE generator. Current flowing through this device has a positive temperature coefficient and also flows through R3. R2 functions with R3 to amplify this coefficient. |
| 1R3, 3R3, 5R3 | Target Resistor. This resistor serves as part of both the negative and positive temperature coefficient blocks. The voltage across this resistor should be equal to the TARGET voltage plus a parasitic term due to the presence of Q3's base current (which must be cancelled out). |
| 1Q3, 3Q3, 5Q3 | Gain Stage Transistor. This device fixes the collector of Q2 to a voltage that is one diode drop above the VEE1 rail. This device also serves as the summing junction for the regulator's forward and feedback paths. |
| 1Q8, 3Q8, 5Q8 | Negative Temperature Coefficient Transistor. In that the base-emitter voltage becomes smaller as temperature increases, the current flowing through R5 also becomes smaller. This reduces the current flowing through R3 and thereby produces the negative voltage coefficient. |
| 1R5, 3R5, 5R5 | Negative Temperature Coefficient Resistor which is referred to above in regard to Q8. |
| 1R6, 3R6, 5R6 | Negative Temperature Coefficient Current Source Resistor. This resistor ensures that sufficient |

-continued

| Device | Function: |
|---|---|
| | current flows through Q8 so that Q8's Vbe will be effective and that the temperature coefficient associated with the base-emitter junction will be relatively uniform over temperature. |
| 1R7, 3R7, 5R7 | Base Current Compensation Resistor. This resistor functions with the base current from Q6 to cancel out the base current effects of Q3 on R3 (one of the aforementioned parasitic terms). |
| 1R4, 3R4, 5R4 | Feedback Resistor. This device forms the beginning of a feedback path and functions to set the current through Q6 and Q3. |
| 1Q5B, 3Q5B, 5Q5B | Step Down Transistor. This device reduces the magnitude of the base-collector voltage of devices Q4 (or Q4B) and Q8. As was previously noted, the use of this device may not be required for all applications. However, this device insures proper circuit operation at higher than nominal voltages. |
| 1QD, 3QD, 5QDA | Step Down Transistor. This device reduces the magnitude of the base-collector voltage of device Q3. Thus, this device insures that Q3 will better match Q6 and that the bipolar capacitor (if needed) will have a relatively low junction voltage. |
| 1C1, 3C1, 5C1 | Stability Capacitor. This capacitor is employed to maintain overall regulator stability. As was stated, C1 may not be required, dependent upon the selected technology characteristics. |

The following is a summary of comparisons between the master bias regulator 3 and the Modified Matched-Pair Cancellation Master Regulator 5, wherein both regulators are optimized to produce 500 mV across teh current source resistor (RCS) at the followign nominal conditions: Temperature 85.0C; VEE1 Voltage −5.2 V; VCC Voltage 0.0 V; Transistor Beta 110.0; and Loading (IVREF1) 0.5 mA.

For a temperature tracking variation over a range of 25C to 115C the regulator 3 exhibits a change in VREF1 of −0.022 mV/C while the regulator 5 exhibits a change in VREF1 of only −0.013 mV/C. For a vEE1 voltage variation over a range of −4.68 V to −5.72 V the regulator 3 exhibits a change in VREF1 of ± 5.0 mV while the regulator 5 exhibits a change of in VREF1 of ±0.0 mV. For a transistor Beta that varies over a range of B=50 to B=220 the regulator 3 exhibits a change in VREF1 of ±0.9 to 5.0 mV while the regulator 5 exhibits a change in VREF1 of only +0.6 to −0.1 mV. For a loading (IVREF1 over a range of 0 mA to 1 mA the regulator 3 exhibits a change in VREF1 of ±10.3 mV while the regulator 5 exhibits a change in VREF1 of only ±0.8 mV. Finally, the power consumption of the regulator 3 exhibits a change of 36.71 mW while the regulator 5 exhibits a change of only 12.27 mW.

While the invention has been particularly shown and described with respect to a preferred embodiment thereof, it will be understood by those skilled in the art that changes in form and details may be made therein without departing from the scope and spirit of the invention.

What is claimed is:

1. A master voltage regulator, comprising:

a master voltage regulator circuit having an output node for providing a first output poential regulated over a range of output currents;

at least one slave voltage regulator connected to receive as an input the first output potential from the output node of the master voltage regulator circuit and to provide a second output potential to at least one load coupled to an output of the slave voltage regulator; and the master voltage regulator circuit further including:

first compensating means, coupled to the output node, for compensating the first output potential for a temperature-related characteristic of the at least one load; and second compensating means, coupled to the output node, for compensating the first output potential for a temperature-related characteristics of the at least one slave voltage regulator.

2. A master voltage regulator as set forth in claim 1 wherein the output node is coupled to an emitter terminal of an output transistor.

3. A master voltage regulator as set forth in claim 2 wherein the first compensating means includes a first transistor having a base terminal coupled to a collector of the output transistor and an emitter terminal coupled in series with an output node of the second compensating means.

4. A master voltage regulator as set forth in claim 3 wherein an input node of the second compensating means is coupled to means for generating a negative temperature coefficient current and to means for generating a positive temperature coefficient voltage for providing the first output potential with a predetermined temperature characteristic.

5. A master voltage regulator as set forth in claim 2 wherein the emitter of the output transistor is coupled to means for nulling an inherent temperature dependency of the second compensating means.

6. A master voltage regulator as set forth in claim 4 wherein the means for generating a positive temperature coefficient voltage includes a current source, wherein the second compensating means induces a temperature-related dependency in the operation of the current source, and wherein the emitter of the output transistor is coupled to means for nulling the temperature-related dependency induced by the second compensating means.

7. A master voltage regulator as set forth in claim 3 wherein the second compensating means is comprised of a first diode means having an anode coupled to the emitter of the first transistor.

8. A master voltage regulator as set forth in claim 1, wherein the master voltage regulator is coupled between a first power rail, having a potential of approximately zero volts DC, and a second power rail, having a potential within a range of approximately −4.0 volts DC to approximately −7.0 volts DC.

9. A master voltage regulator as set forth in claim 7 wherein the master voltage regulator is coupled between a first power rail, having a potential of approximately zero volts DC, and a second power rail, having a potential within a range of approximately −4.0 volts DC to approximately −7.0 volts DC, and further including a gain stage comprising a transistor having an emitter terminal coupled to the second power rail, a base terminal coupled to an output of means for generating a negative temperature coefficient current and to an output of means for generating a positive temperature coefficient, voltage the gain stage transistor further having a collector terminal coupled to a base terminal of the output transistor.

10. A master voltage regulator as set forth in claim 9 and further including second diode means coupled to the collector terminal of the gain stage transistor for reducing the collector potential thereof by an amount substantially equal to an amount of an increase in collector potential caused by the first diode means.

11. A master voltage regulator as set forth in claim 10 and further comprising a capacitance coupled between the base terminal of the gain stage transistor and the collector terminal of the gain stage transistor.

12. A master voltage regulator as set forth in claim 1 wherein the first output potential is greater than the second output potential by an amount sufficient to compensate for voltage drop due to current requirement of the slave voltage regulator.

13. A master voltage regulator, comprising:

a master voltage regulator circuit having an output node coupled to an emitter of an output transistor for providing a first output potential regulated over a range of output currents;

at least one slave voltage regulator connected to receive as an input the first output potential from the output node of the master voltage regulator and to provide a second output potential to at least one emitter coupled logic load coupled to an output of the slave voltage regulator; and the master voltage regulator circuit further including:

first compensating means for compensating the first output potential for a temperature-related characteristic of the at least one emitter coupled logic load, the first compensating means including a first transistor having a base terminal coupled to a collector of the output transistor and an emitter terminal coupled in series with an output node of a second compensating means, the second compensating means compensating the first output potential for a temperature-related characteristic of the at least oen slave voltage regulator.

14. A master voltage regulator as set forth in claim 13 wherein an input node of the second compensating means is coupled to means for generating a negative temperature coefficient current and to means for generating a positive temperature coefficient voltage for providing the first output potential with a predetermined temperature characteristic.

15. A master voltage regulator as set forth in claim 13 wherein the emitter of the output transistor is coupled to means for nulling an inherent temperature dependency of the second compensating means.

16. A method of supplying a reference potential to one or more emitter coupled logic (ECL) loads, comprising the steps of:

generating a temperature-compensated master reference potential;

supplying the master reference poential as an input to at least one slave voltage regulator;

supplying the one or more emitter coupled logic loads with a reference potential output from the at least one slave voltage regulator; and wherein the step of generating a temperature-compensated master reference potential includes the steps of:

compensating the master reference potential for a temperature-related characteristic of the one or more emitter coupled logic loads; and compensating the master reference potential for a temperature-related characteristic of the at least one slave voltage regulator.

* * * * *